US007644476B2

(12) United States Patent
Takamura

(10) Patent No.: US 7,644,476 B2
(45) Date of Patent: Jan. 12, 2010

(54) CAP FOR BUTTON, FIXING MEMBER AND BUTTON

(75) Inventor: Yoshio Takamura, Kurobe (JP)

(73) Assignee: YKK Corporation, Tokyo (JP)

( * ) Notice: Subject to any disclaimer, the term of this patent is extended or adjusted under 35 U.S.C. 154(b) by 425 days.

(21) Appl. No.: 11/636,190

(22) Filed: Dec. 8, 2006

(65) Prior Publication Data

US 2007/0143969 A1 Jun. 28, 2007

(30) Foreign Application Priority Data

Dec. 28, 2005 (JP) ..... 2005-380079

(51) Int. Cl.
*A44B 1/00* (2006.01)
*A44B 1/04* (2006.01)
*A44B 1/08* (2006.01)

(52) U.S. Cl. ..... 24/113 R; 24/114.12; 24/113 MP

(58) Field of Classification Search ..... 24/92, 24/114.12, 114, 113 R, 113 MP
See application file for complete search history.

(56) References Cited

U.S. PATENT DOCUMENTS

| | | | | | |
|---|---|---|---|---|---|
| 366,688 | A | * | 7/1887 | Roebuck | 24/92 |
| 894,080 | A | * | 7/1908 | Swanson | 24/113 R |
| 1,113,211 | A | | 10/1914 | Greenbaum | |
| 1,442,606 | A | | 1/1923 | Day | |
| 1,449,706 | A | | 3/1923 | Styles | |
| 1,858,441 | A | | 5/1932 | Fenton | |
| 1,936,624 | A | * | 11/1933 | Gelpcke | 24/113 MP |
| 1,990,670 | A | | 2/1935 | Rau | |
| 2,314,751 | A | | 3/1943 | Woodward | |
| 2,513,182 | A | * | 6/1950 | Koehl et al. | 24/113 R |
| 4,044,433 | A | * | 8/1977 | Aureli | 24/690 |

FOREIGN PATENT DOCUMENTS

| | | |
|---|---|---|
| JP | UM-A-57-186515 | 11/1982 |
| JP | 60-65011 | 5/1985 |
| JP | 62-7207 | 1/1987 |
| JP | 63-138114 | 9/1988 |
| JP | 63-148205 | 9/1988 |

OTHER PUBLICATIONS

Office Action in corresponding Japanese Application No. 2005-380079, dated Aug. 25, 2009.

* cited by examiner

*Primary Examiner*—Robert J Sandy
(74) *Attorney, Agent, or Firm*—Alston & Bird, LLP

(57) ABSTRACT

Provided is a cap (41) for a button, of which material is a polygonal plate. The cap (41) includes a main surface covering portion (42) formed substantially at the center of the polygonal plate and a plurality of holding piece portions (44) formed by bending corners of the polygonal plate from an outer peripheral end of the main surface covering portion (42) to a rear surface side of the main surface covering portion (42). Provided between the main surface covering portion (42) and the plurality of holding piece portions (44) is a lateral side covering portion (43) around the outer peripheral end of the main surface covering portion (42).

7 Claims, 10 Drawing Sheets

PRIOR ART

PRIOR ART

PRIOR ART

CAP FOR BUTTON, FIXING MEMBER AND BUTTON

BACKGROUND OF THE INVENTION

1. Field of the Invention

The present invention relates to a button cap for covering an outer surface of a button, a fixing member for fixing a button main body to a fabric and a button using the button cap or the fixing member, which are for buttons for holding mating portions of a garment or ornamental buttons mainly used for decorative purposes.

2. Description of Related Art

Buttons include buttons for holding mating portions of a garment and ornamental buttons mainly used for decorative purposes. Such buttons each include a male button and a female button which are fitted to each other. Generally, the male button is attached on one of the mating portions of a fabric and the female button is attached on the other mating portion such that the male and female buttons face each other. By fitting the male button in the female button, the mating portions of the fabric are held together.

The male and female buttons each have a button main body attached on a mating surface of the fabric and a fixing member for fixing the button main body to the fabric by holding the button main body from the other side of the mating surface of the fabric.

FIG. 9 shows a button main body 10 and a fixing member 20 of a prior art female button.

The button main body 10 includes a base cylindrical portion 11 to abut to a fabric 1 and a fitting cylindrical portion 13 integrally formed so as to extend from the base cylindrical portion 11. The fitting cylindrical portion 13 has a cylindrical shape and a larger diameter than that of the base cylindrical portion 11. An opening 12 is formed at the center of a surface of the base cylindrical portion 11, the surface abutting to the fabric 1. The fixing member 20 is inserted through the opening 12 and engaged therein, so that the button main body 10 is fixed to the fabric 1. A male button insertion hole 14 is formed in the fitting cylindrical portion 13 on the opposite side of the mating surface of the fabric 1. Male button engaging springs 15 are accommodated in the fitting cylindrical portion 13.

As shown in FIG. 10, the fixing member 20 includes a fixing member main body 21 and a cap 31 to cover an outer surface of the fixing member main body 21.

The fixing member main body 21 includes a flange portion 22 substantially in a circular plate shape, a connecting cylindrical portion 23 and an engaging axial portion 24 integrally formed from the flange portion 22 via the connecting cylindrical portion 23 at the center of the flange portion 22.

The cap 31 includes a main surface covering portion 32 in a circular plate shape to cover an outer surface of the flange portion 22 and a holding portion 34 to be bent inward in an arc shape from an outer periphery of the main surface covering portion 32 to hold an outer periphery of the flange portion 22.

As one example of such a fixing member, a metal female hock disclosed in JP-63-148205-U is known.

As shown in FIG. 11, the cap 31 has been conventionally manufactured by blanking a circular plate blank 36 out of a plate material with a press machine and then drawing the circular plate blank 36 into a short cylindrical cap 31 with the press machine. The cap 31 has been manufactured to have a short cylindrical shape with the main surface covering portion 32 of the circular plate shape as a bottom wall and the holding portion 34 of the cylindrical shape as an outer peripheral wall.

The flange portion 22 of the fixing member main body 21 is placed in the cap 31 and an end of the cylindrical holding portion 34 is curled inward and clinched, thereby manufacturing the fixing member 20.

The prior art manufacturing method of the cap contains the following disadvantages.

(a) In a blanking process of the circular plate blanks 36 out of the plate material, when the circular plate blanks 36 with the outer circumferences contacting to each other, the outer circumferences may be deformed, so that the blanked-out circular plate blanks 36 are not accurate. To prevent this problem, the adjacent circular plate blanks 36 are disposed with a margin of about 1 mm therebetween in the blanking process of the circular plate blanks 36. After the blanking process, the margin portion is left in a frame shape in the plate material. Thus, the deformation of the outer circumference of the blank 36 is avoided of the blanked in a contacting state with no bridge, such circular plate blanks 36 cannot be accurate. However, providing the margin may reduce the material use efficiency.

(b) When clinching the short cylindrical cap 31 obtained by drawing the circular plate blank 36 to a component of the button (for example, the fixing member main body 21), the end of the holding portion 34 continuously extending from the outer periphery of the main surface covering portion 32 needs to be curled inward. In other words, the entire circumference of the peripheral wall of the cylindrical holding portion 34 needs to be clinched, requiring a large load. Hence, a punch or a die used for clinching may be damaged.

(c) When a garment with the above-described button is soaked in a liquid for washing or decoration, the liquid may remain in the cap 31 especially in an inner space of the curled portion of the cylindrical holding portion 34, which may cause discoloration or degradation of the garment.

(d) In a state in which the cap 31 is clinched to the fixing member main body 21, the entire circumference of the cylindrical holding portion 34, that is, the entire circumference of the clinched portion is curled inward to abut to the fixing member main body 21. Accordingly, when the fixing member main body 21 or the cap 31 has a circular shape, the cap 31 may easily rotate relative to the fixing member main body 21. Hence, when the cap 31 has an image pattern or a character thereon, the orientation of the image pattern or the character may vary. It is not preferable in terms of design.

SUMMARY OF THE INVENTION

An object of the present invention is to solve the aforesaid problems and to provide a cap for a button, a fixing member and a button which provide improved material use efficiency, reduced load in clinching, alteration prevention due to remaining liquid, rotation prevention of the cap and the like.

According to an aspect of the invention, a material of a cap for a button is a polygonal plate. The cap includes: a main surface covering portion formed substantially at the center of the polygonal plate; and a plurality of holding piece portions formed by bending corners of the polygonal plate from an outer peripheral end of the main surface covering portion to a rear surface side of the main surface covering portion.

According to the aspect of the invention, the cap is made from the polygonal plate, so that a plurality of polygonal plates can be blanked out of a plate material with sides of the polygonal plates disposed apart from each other but faced to each other. Hence, the material cost can be reduced, so that the material use efficiency can be improved.

To attach the cap to a button component such as a button main body and a fixing member, first the cap is attached to the button component so as to cover a main surface of the button component by the main surface covering portion of the cap. Then, the plurality of holding piece portions is clinched to the rear surface side of the main surface covering portion. Herein, since the plurality of holding piece portions has a substantially triangular shape, the load required in clinching can be reduced as compared with the case of clinching a conventional cylindrical portion in the inward direction. Hence, the reduction in load in clinching may reduce damage on a punch or a die used for clinching the plurality of holding piece portions.

When the cap is attached to the button component, there is a gap between the adjacent holding piece portions. Accordingly, even when a garment or the like with the cap for the button attached is soaked in, for example, washing liquid, the washing liquid can flow out from the gap between the adjacent holding piece portions. Thus, by providing the gap between the adjacent holding piece portions, the liquid can drain more easily, thereby preventing quality deterioration such as discoloration or degradation due to the remaining liquid.

Further, when the cap is attached to the button component, a corner of each holding piece portion bites into the button component, thereby preventing a rotation of the cap. Hence, even when the cap is provided with an image pattern or a character thereon, it is possible to avoid design deterioration.

In the cap for the button according to the aspect of the invention, a lateral side covering portion may be preferably formed around the outer peripheral end of the main surface covering potion between the main surface covering portion and the plurality of holding piece portions.

According to the aspect of the invention, the lateral side covering portion is formed in a ring shape around the outer periphery of the main surface covering portion, so that a lateral side of the button component is covered by the lateral side covering portion of the cap when the cap is attached to the button component. In other words, the ring lateral side covering portion is formed around the outer periphery of the main surface covering portion, so that the main surface and the lateral surface of the button component are respectively covered by the main surface covering portion and the lateral side covering portion of the cap. Accordingly, the design and appearance can be enhanced. In addition, no hole or notch is exposed from the lateral side portion, so that a garment and the like are not clawed.

In the cap for the button according to the aspect of the invention, the polygonal plate may be preferably a polygonal shape having a substantially common distance from the outer peripheral end of the main surface covering portion to each of the corners.

For example, when the shape of the main surface covering portion is circular, the shape of the polygonal plate may be an equilateral triangle, an equilateral square or an equilateral hexagon.

According to the aspect of the invention, when the corners are bent from the outer peripheral end of the main surface covering portion to the rear surface side of the main surface covering portion, distances from the outer peripheral end of the main surface covering portion to the corners are substantially equal. In other words, due to the bending of the corners from the outer peripheral end of the main surface covering portion to the rear surface side of the main surface covering portion, lengths of the plurality of holding piece portions are substantially equal. Accordingly, the holding piece portions can hold the button component equally by an equivalent force. Hence, a structure can be obtained, in which the cap and the button component are not easily disengaged or a rotation thereof can be avoided.

In the cap for the button according to the aspect of the invention, the polygonal plate may be preferably any of an isosceles triangle, a right-angle triangle, an equilateral triangle, a regular tetragon and an equilateral hexagon.

According to the aspect of the invention, when blanking the plurality of polygonal plates out of the plate material, the plurality of polygonal plates can be disposed vertically and horizontally for blanking. Hence, the material use efficiency can be further improved.

In the cap for the button according to the aspect of the invention, the polygonal plate may be preferably a metal plate.

According to the aspect of the invention, when the cap is attached to the button component, the corner of each holding piece portion bites into the button component. When the polygonal plate is a metal plate, biting degree can be increased. Thus, rotation prevention effect of the cap can be further enhanced.

A fixing member according to an aspect of the invention penetrates a fabric from one surface to the other surface and fixes a button main body on the other surface side of the fabric. The fixing member includes: a fixing member main body which penetrates the fabric from one surface to the other surface and fixes the button main body on the other surface side of the fabric; and a cap for covering an outer surface of the fixing member main body on the one surface side of the fabric. The cap herein is the cap according to the aforesaid aspect of the invention.

A button according to an aspect of the invention includes a button main body and a fixing member which penetrates a fabric from one surface to the other surface and fixes the button main body on the other surface side of the fabric. The fixing member includes: a fixing member main body which penetrates the fabric from one surface to the other surface and fixes the button main body on the other surface side of the fabric; and a cap for covering an outer surface of the fixing member main body on the one surface side of the fabric. The cap herein is the cap according to the aforesaid aspect of the invention.

The fixing member or the button may also have the above described advantages of the cap.

In a button according to an aspect of the invention, a material of the button is a polygonal plate. The button includes: a button main body formed substantially at the center of the polygonal plate; and a plurality of holding piece portions formed by bending corners of the polygonal plate from an outer peripheral end of the button main body to a rear surface side of the button main body.

According to the aspect of the invention, the plurality of holding piece portions is set so as to penetrate the fabric from one side to the other side and then bent to the rear surface side of the button main body. Accordingly, the fabric can be held by the button main body and the holding piece portions. Thus, the button is attached to the fabric, which provides the same effects and advantages as those of the cap. The button herein may also have the advantages of the above described cap.

DETAILED DESCRIPTION OF PREFERRED EMBODIMENT(S)

An embodiment of the invention will be described below with reference to the attached drawings.

Figure 1A:
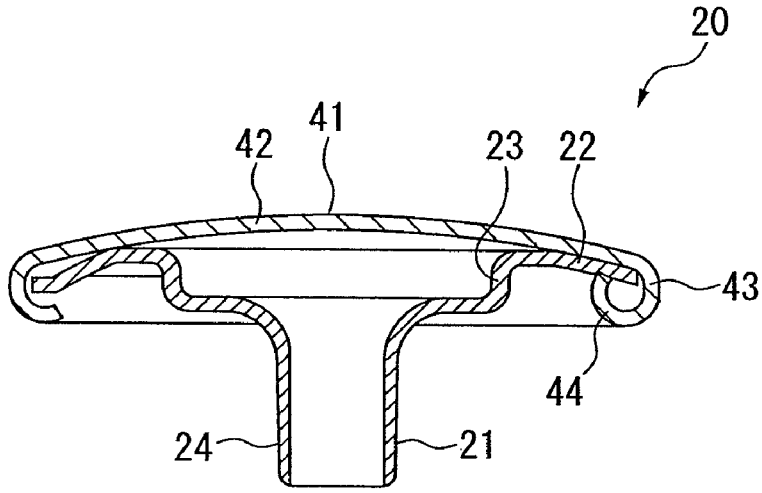
FIGS. 1A and 1B are respectively a cross sectional view and a bottom view of an embodiment of the present invention.
Figure 1B:
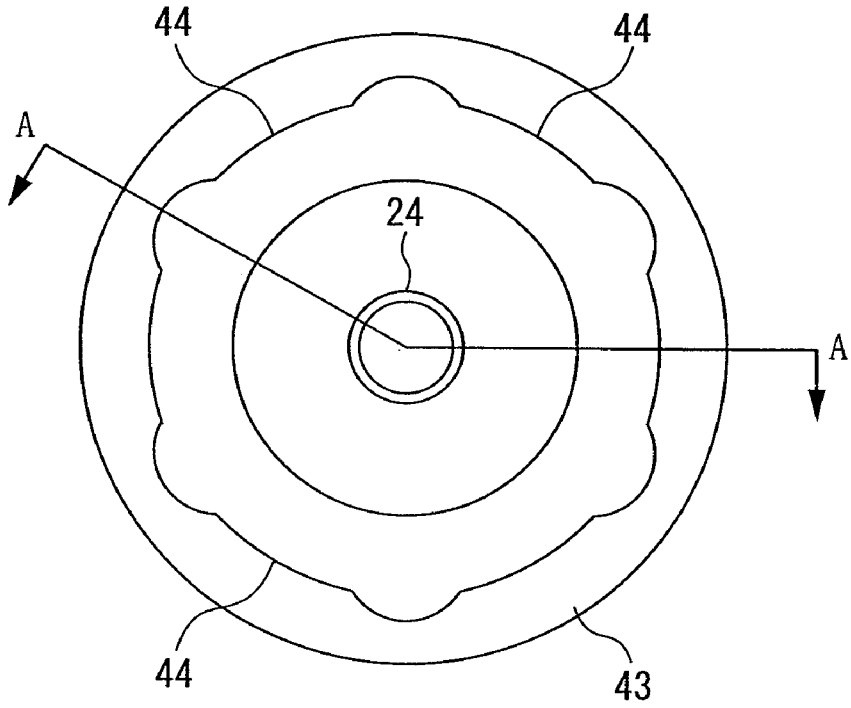
Figure 2:
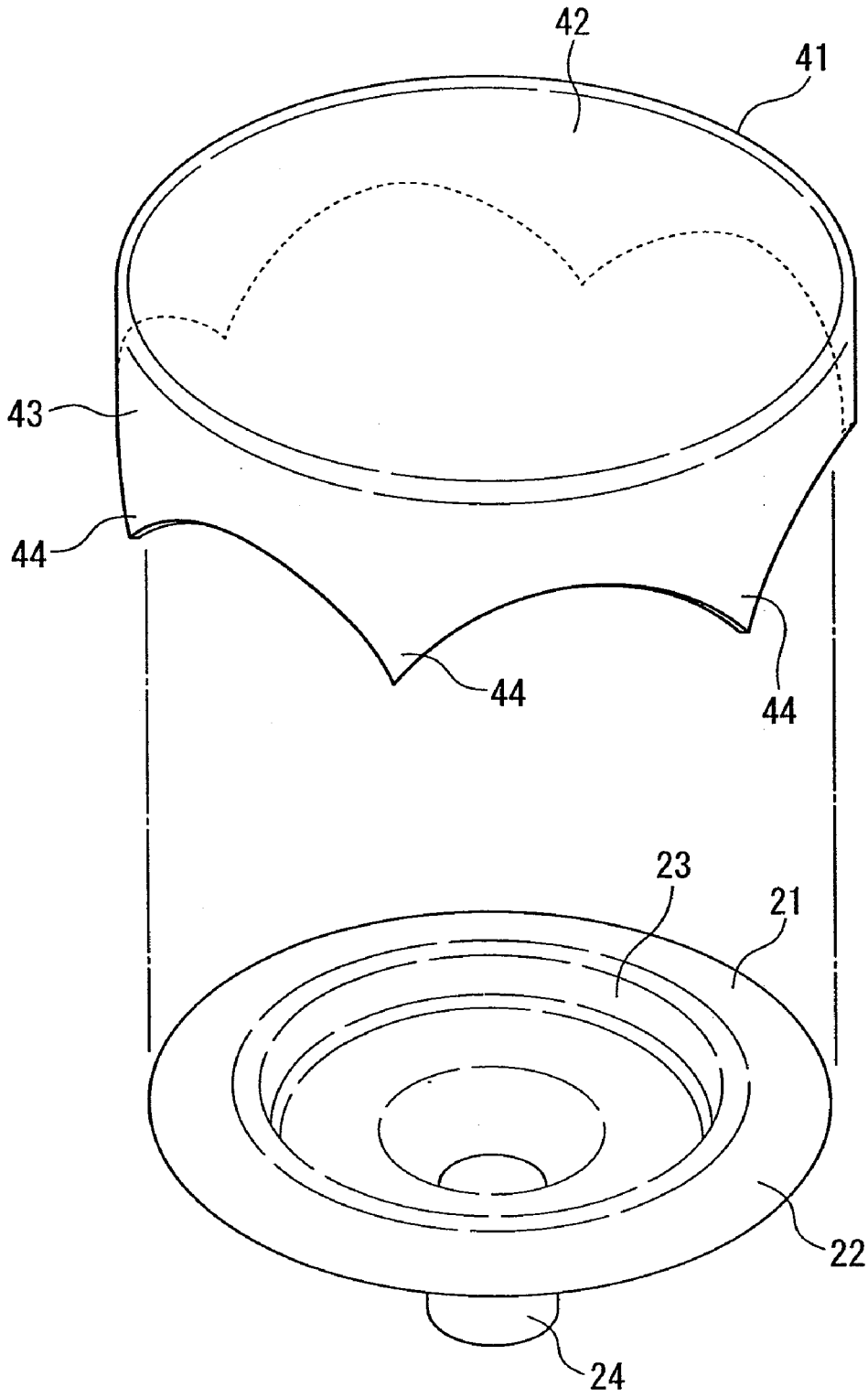
FIG. 2 shows an exploded perspective view of the aforesaid embodiment.

The embodiment is an application example to a fixing member 20 of a female button described above. FIGS. 1A and 1B are respectively a cross sectional view and a bottom view of a fixing member 20 according to the embodiment. FIG. 1A is a cross section taken along the A-A line of FIG. 1B. FIG. 2 is an exploded perspective view of FIGS. 1A and 1B.

Figure 9:
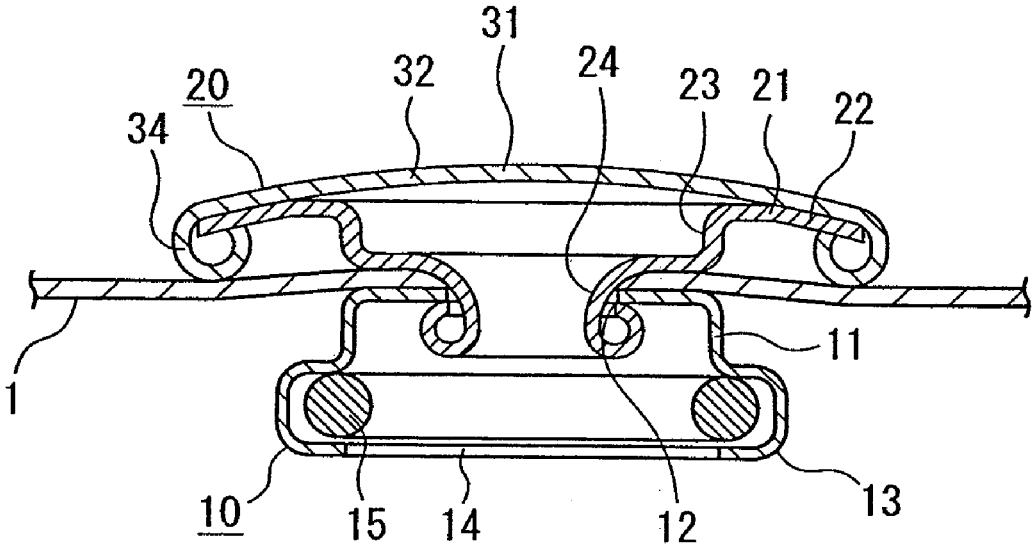
FIG. 9 is a cross section of a button (a female button).
Figure 10:
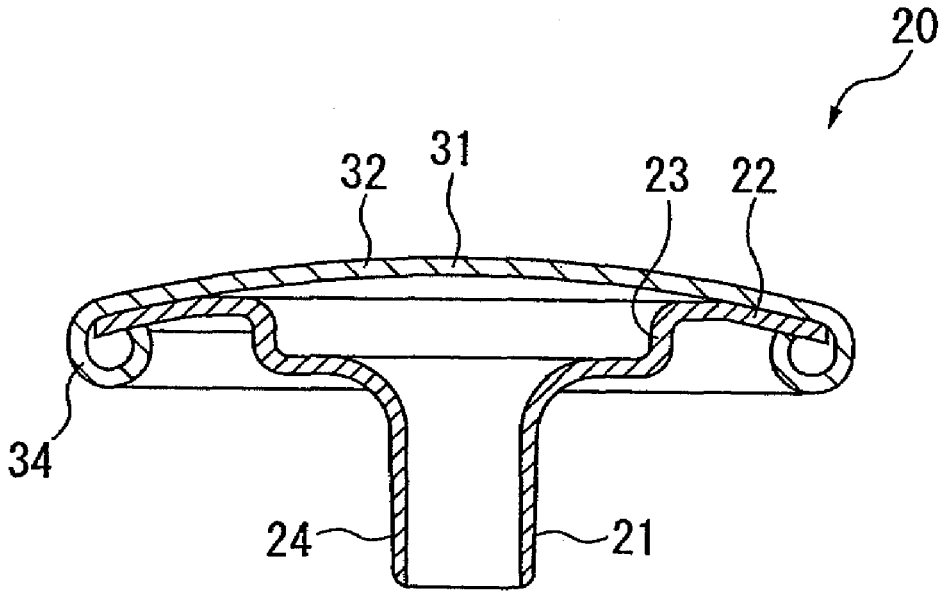
FIG. 10 is a cross section showing a fixing member of the button (the female button) shown in FIG. 9.
Figure 11:
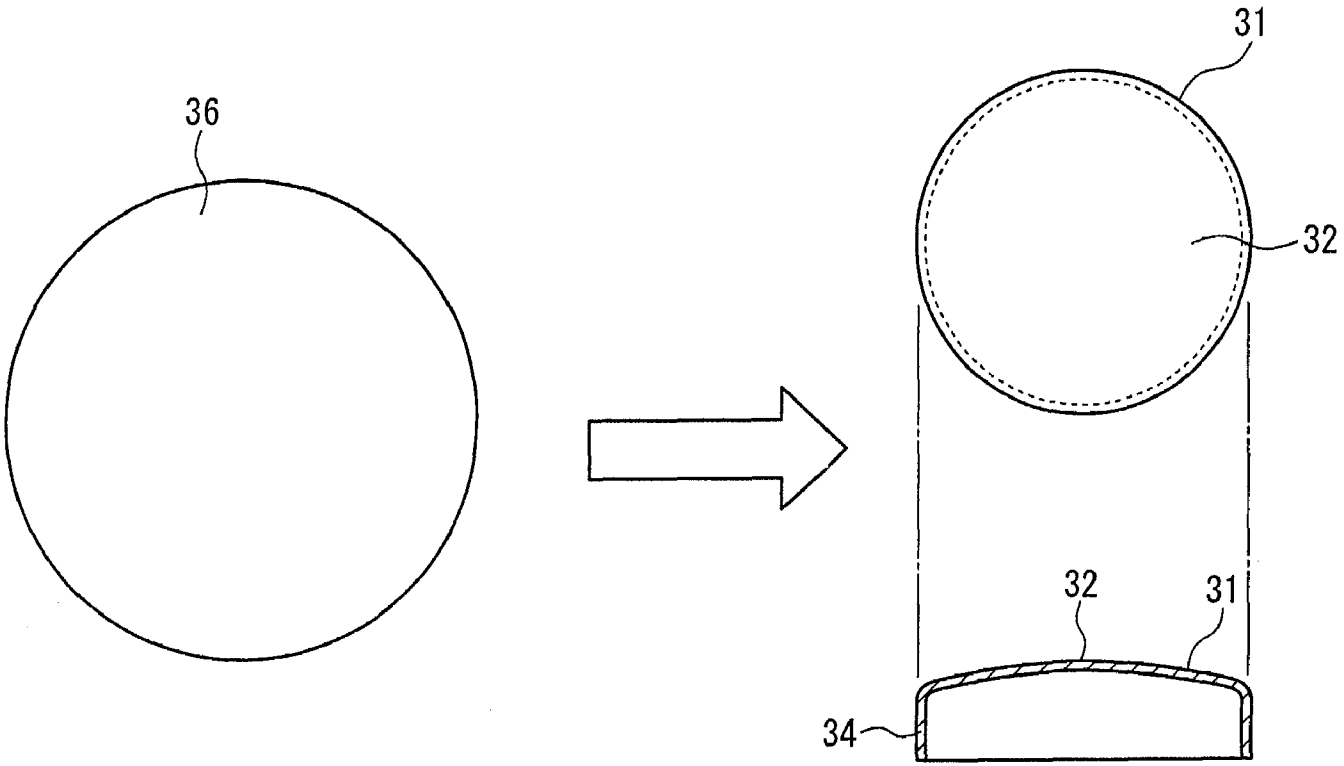
FIG. 11 shows a manufacturing process of the fixing member shown in FIG. 10.

As shown in FIGS. 1 and 2, the fixing member 20 of the embodiment penetrates a fabric 1 from one surface to the other surface. The fixing member 20 includes a fixing member main body 21 for holding a button main body on the other surface of the fabric 1 (see a button main body 10 in FIG. 9) and a cap 41 for covering an outer surface of the fixing member main body 21 on the other surface side. The fixing member main body 21 is the same as the fixing member main body 21 of FIG. 9. Only the difference is that the cap 41 is not the same as the cap 31 of FIG. 9.

The cap 41 is made from a polygonal plate. The cap 41 includes a main surface covering portion 42 substantially in the center portion of the polygonal plate, a lateral side covering portion 43 having a ring shape formed by bending corners of the polygonal plate from an outer peripheral end of the main surface covering portion 42 toward a rear surface side of the main surface covering portion 42. The cap 41 also includes a plurality of holding piece portions 44.

Figure 3:
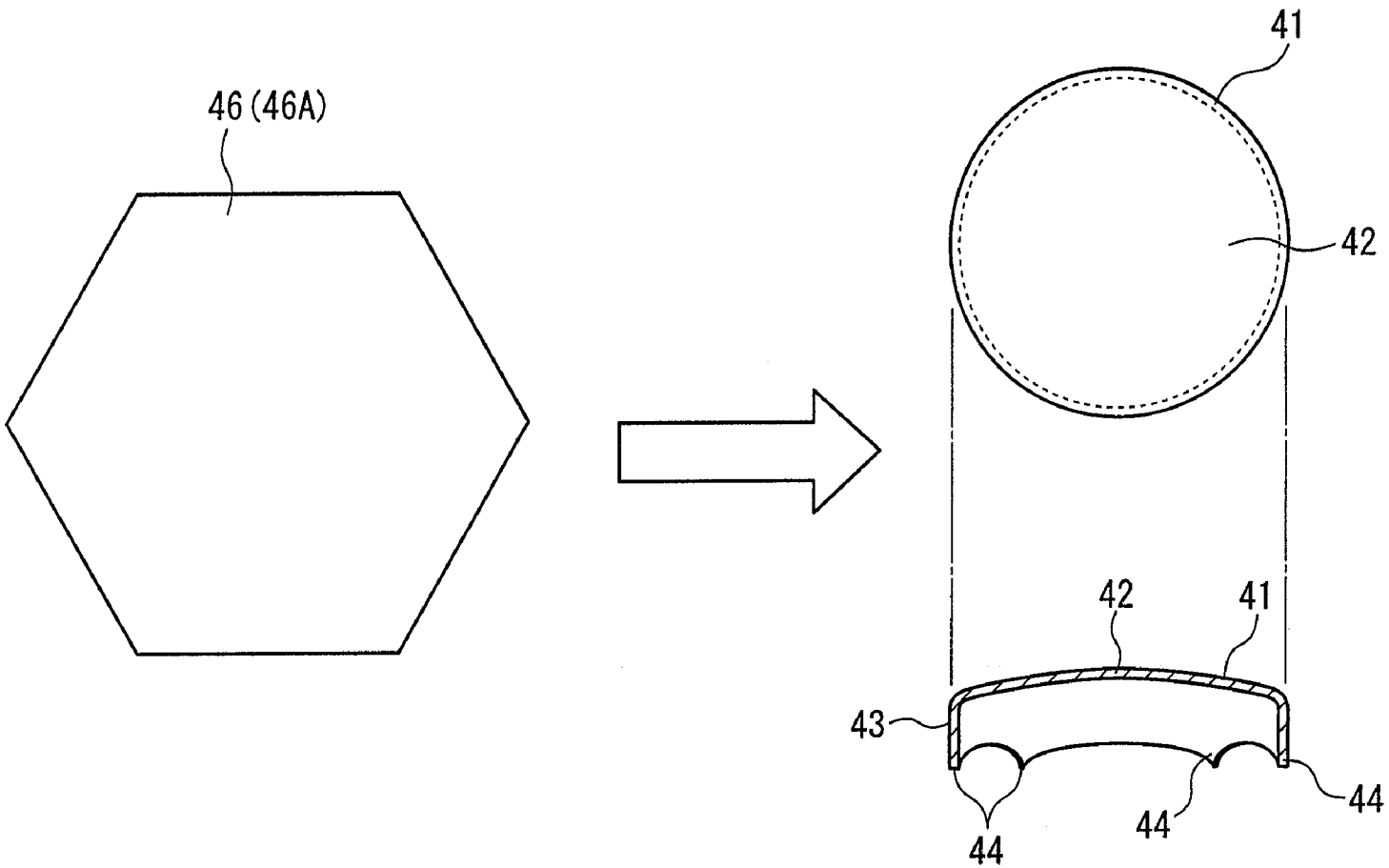
FIG. 3 shows a manufacturing process of a cap according to the aforesaid embodiment.

More specifically, the manufacturing method is as follows. As shown in FIG. 3, a plurality of equilateral hexagonal plate 46A is blanked out of a metal plate (of brass or the like). The plurality of equilateral hexagonal plates 46A is blanked apart from each other with sides faced to each other. Accordingly, the plurality of equilateral hexagonal plates 46A is blanked in a vertically and horizontally disposed manner, thereby reducing the material cost.

Next, each equilateral hexagonal plate 46A is used as a blank material to manufacture the cap 41 by drawing using the press machine. The equilateral hexagonal plate blank is placed on a die of the press machine and drawn downward by the press machine.

As a result, the main surface covering portion 42 is formed substantially at the center of the equilateral hexagonal plate 46A. The lateral side covering portion 43 is formed in a ring shape around the outer peripheral end of the main surface covering portion 42. Thus, the cap 41 is obtained, which includes the plurality of holding piece portions 44 at the end.

The cap 41 is then attached to the fixing member main body 21. Specifically, the cap 41 is placed on the die of the press machine with the main surface covering portion 42 down and the fixing member main body 21 is accommodated in the cap 41. The holding piece portions 44 of the cap 41 are clinched inward, so that the plurality of holding piece portions 44 is folded toward the rear surface side of the main surface covering portion 42 to hold the outer peripheral end of the flange portion 22 of the fixing member main body 21.

Figure 4A:
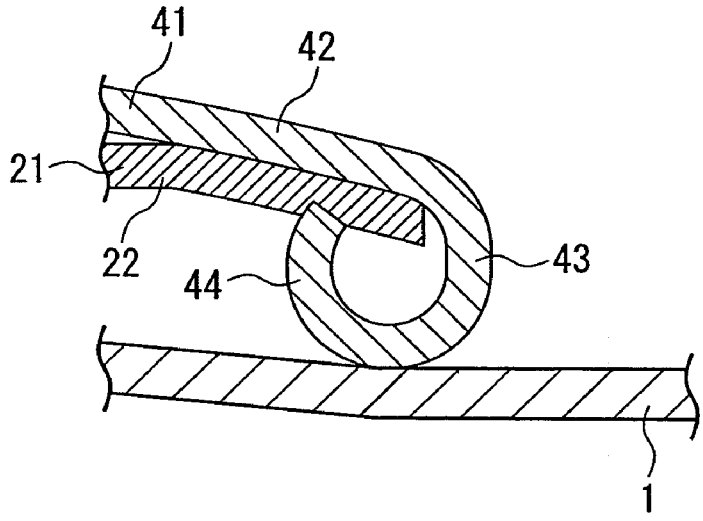
FIGS. 4A and 4B each show how a fixing member main body bites into the cap according to the aforesaid embodiment.
Figure 4B:
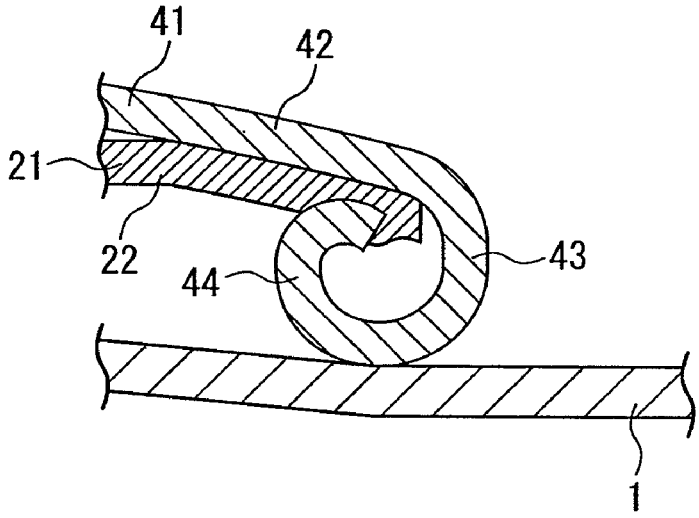

As shown in FIG. 4A, the corner of each holding piece portion 44 bites into the flange portion 22 of the fixing member main body 21. Thus, the bonding force between the cap 41 and the fixing member main body 21 can be enhanced, thereby preventing a rotation of the cap 41. As shown in FIG. 4B, when the corner of the holding piece portion 44 bites into the flange portion 22 of the fixing member main body 21, a part of the flange portion 22 is raised, thereby providing firmer integration therebetween. Hence, even when the cap 41 is provided with an image pattern or a character thereon, it is possible to avoid design deterioration.

In this state, since distances from the outer peripheral end of the main surface covering portion 42 to the corners are common, that is, lengths of the plurality of holding piece portions 44 is common, the holding piece portions 44 can hold the fixing member main body 21 equally by an equivalent force. Accordingly, a structure can be obtained, in which the cap 41 and the fixing member main body 21 are not easily disengaged or a rotation thereof can be avoided.

In addition, since the plurality of holding piece portion 44 has a substantially triangular shape, the load required in clinching can be reduced as compared with the case of clinching the conventional cylindrical holding portion 34 in the inward direction. Hence, damage on the punch or the die used for clinching can be reduced.

When the cap 41 is attached on the fixing member main body 21, the main surface and the lateral side surface of the fixing member main body 21 are covered respectively by the main surface covering portion 42 and the lateral side covering portion 43. Hence, the design and appearance of the cap 41 can be enhanced. In this arrangement, no hole or notch is exposed from the lateral side portion, so that a garment and the like are not clawed.

In addition, a gap is formed between the adjacent holding piece portions 44 (see the left side of FIG. 1A). Accordingly, even when the garment or the like with these components attached is soaked in, for example, washing liquid, the washing liquid can flow out from the gap between the adjacent holding piece portions 44. Thus, the liquid can drain more easily, thereby preventing quality deterioration such as discoloration or degradation due to the remaining liquid.

<Modifications>

The present invention is not limited to the above-described embodiment but modifications, improvements and the like are included in the scope of the invention as long as an object of the invention is attained.

In the aforesaid embodiment, the blank material (the equilateral hexagonal plate 46A) is drawn to form the cap 41. However, the shape of the blank may be any polygonal shape as long as the shape has three sides (a triangle) or more.

Particularly, as long as the distances from the outer peripheral end of the main surface covering portion 42 to the corners are substantially equal, the polygonal plate 46 may not be the equilateral hexagonal plate 46A. Concretely, when the main surface covering portion 42 is circular, the polygonal plate may be any one of an equilateral triangle shape, an equilateral square shape or an equilateral hexagonal shape.

Figure 5:
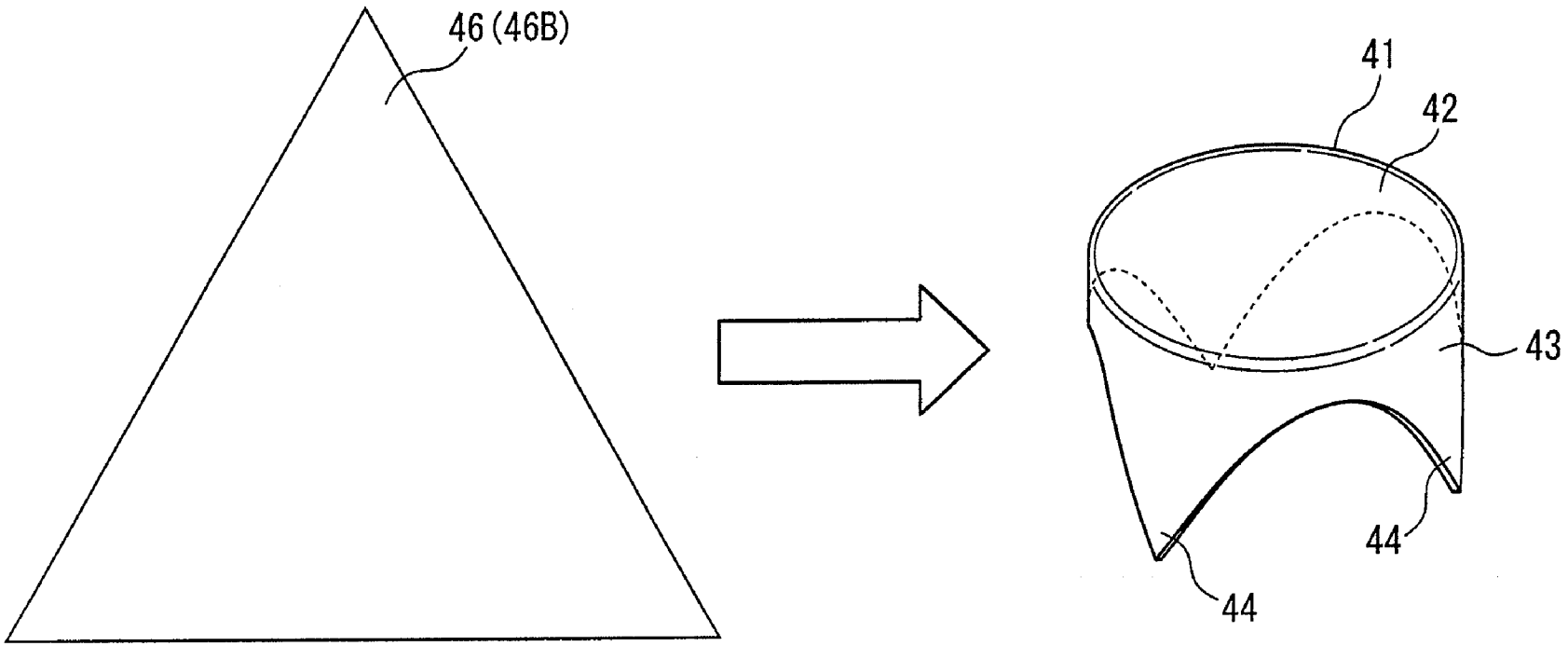
FIG. 5 shows another embodiment of the invention.
Figure 6:
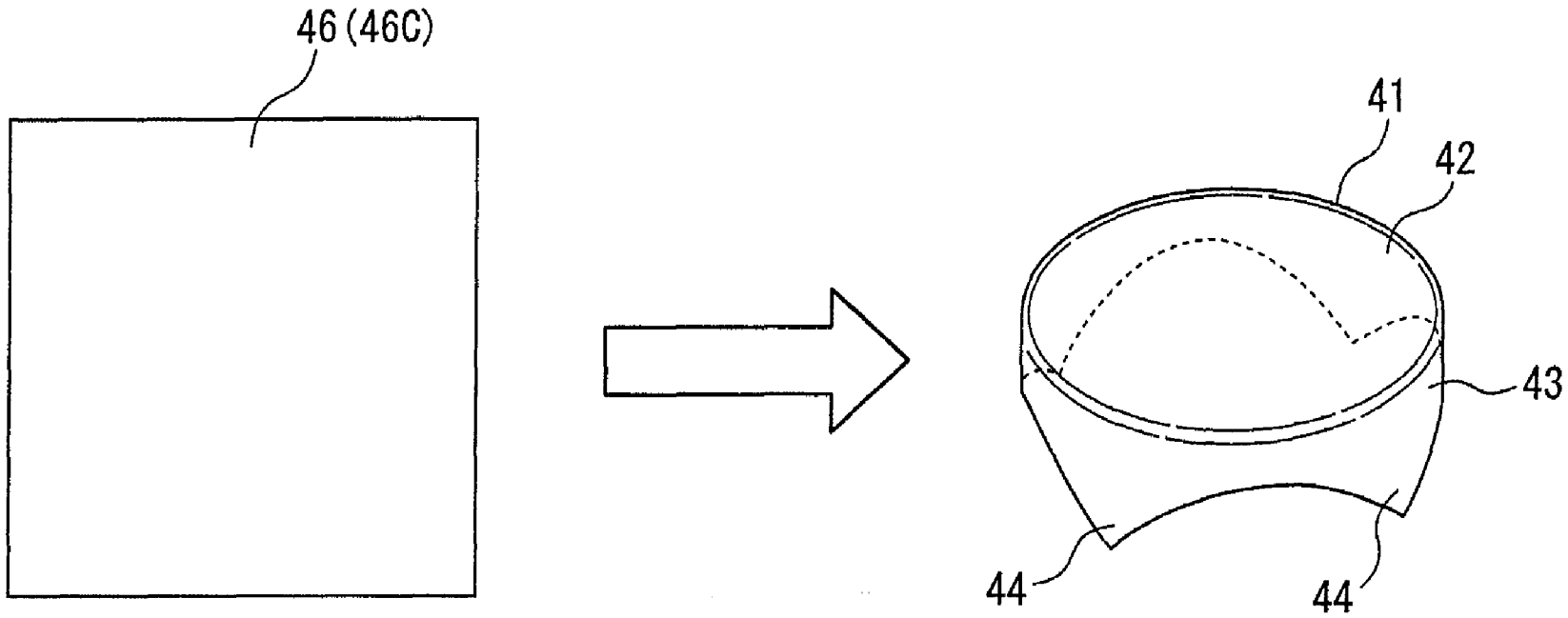
FIG. 6 shows further another embodiment of the invention.

For example, as shown in FIGS. 5 and 6, when the polygonal plate 46 is the equilateral triangle plate 46B or the equilateral square plate 46C, the length of the holding piece portion 44 is longer than that of the holding piece portion 44 of the equilateral hexagonal plate 46A. The angle of the corner is more acute. Hence, the fixing member main body 21 bites more deeply into the flange portion 22. Therefore, the bonding force to the fixing member main body 21 can be increased.

Note that the shape of the main surface covering portion 42 is not limited to circular. The shape may be an ellipse, an oval, a polygonal shape such as a triangle and a rectangle or any other shape.

The polygonal plate 46 may not be the equilateral hexagonal plate 46A. As long as the polygonal plate 46 is any one of an isosceles triangle, a right-angle triangle, an equilateral triangle and a regular tetragon, the yield factor can be further improved because the plurality of polygonal plates can be blanked out in a vertically and horizontally disposed manner. In other words, the polygonal plates are disposed with the sides faced to each other without an unnecessarily large margin to be blanked out of a metal plate, thereby further improving the material use efficiency.

Although the cap 41 used for the fixing member 20 of the female button is described in the aforesaid embodiment, the cap 41 may be used as a cap for a fixing member of a male button.

In addition, the cap 41 of the aspect of the invention is not limited to a snap button including a female button and a male button, but may be used as a cap for covering a head portion of general buttons.

Further, an aspect of the invention may not be limited to the fixing member 20 or the cap 41 of the button, but may be used as a button itself. Specifically, when the cap 41 having the shape according to the aforesaid embodiment is used as a button, the main surface covering portion 42 may be used as the button main body.

Figure 7:
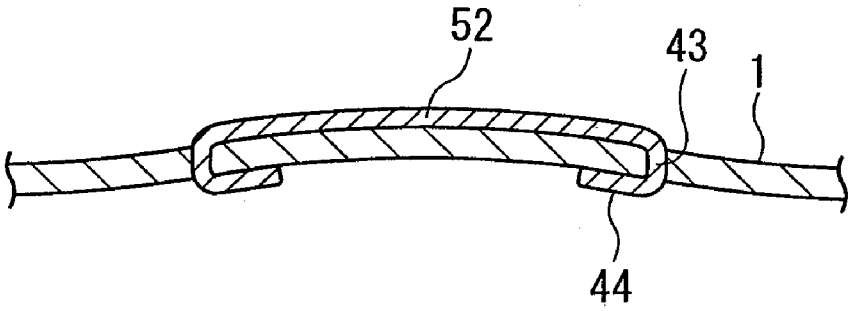
FIG. 7 is a cross section of a button according to an embodiment of the invention.

In order to attach the button to the fabric, as shown in, for example, FIG. 7, the plurality of holding piece portions 44 is set so as to penetrate the fabric 1 from one surface to the other surface and then bent toward a rear surface side of a button main body 52. Accordingly, the fabric 1 is held by the button main body 52 and the holding piece portions 44. Thus, the button can be attached to the fabric 1.

Figure 8:
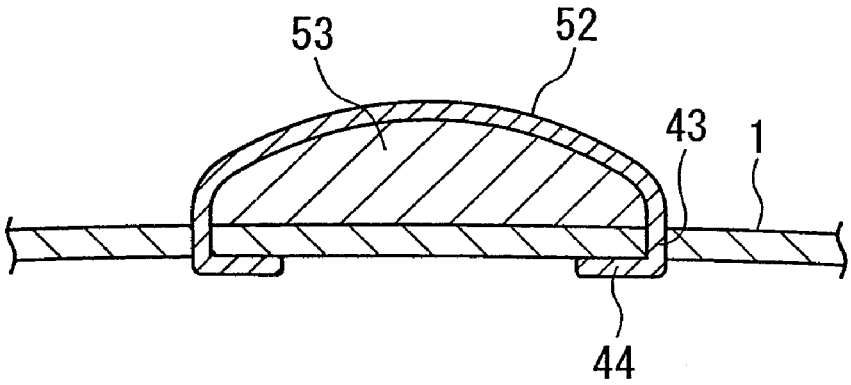
FIG. 8 is a cross section of a button according to another embodiment of the invention.

As shown in FIG. 8, the button can be used as an ornamental button having a more emphasized three-dimensional appearance by inserting an inclusion (a spacer) 53 for increasing the thickness between the button main body 52 and the fabric 1.

In the above-described embodiments, the polygonal plate is metal. However, the plate may not be of metal but any other material as long as the material can ensure certain rigidity.

What is claimed is:

1. A fixing member which penetrates a fabric from one surface of the fabric to the other surface of the fabric and fixes a button main body to the other surface of the fabric, the fixing member comprising:

a fixing member main body which penetrates the fabric from the one surface of the fabric to the other surface of the fabric and fixes the button main body to the other surface of the fabric; and a cap for covering an outer surface of the fixing member main body at the one surface of the fabric, a material of the cap being a polygonal plate, and the cap including: a main surface covering portion formed substantially at the center of the polygonal plate; and a plurality of holding piece portions formed by bending corners of the polygonal plate from an outer peripheral end of the main surface covering portion to a rear surface side of the main surface covering portion.

2. The fixing member according to claim 1, wherein the cap further includes a lateral side covering portion formed around the outer peripheral end of the main surface covering portion between the main surface covering portion and the plurality of holding piece portions.

3. The fixing member according to claim 1, wherein the polygonal plate is a polygonal shape having a substantially common distance from the outer peripheral end of the main surface covering portion to each corner.

4. The fixing member according to claim 1, wherein the polygonal plate is selected from the group consisting of: one of an isosceles triangle, a right-angle triangle, an equilateral triangle, a regular tetragon, and an equilateral hexagon.

5. The fixing member according to claim 1, wherein the polygonal plate is a metal plate.

6. A button comprising:

a button main body; and a fixing member which penetrates a fabric from one surface of the fabric to the other surface of the fabric and fixes the button main body to the other surface of the fabric, the fixing member comprising: a fixing member main body which penetrates the fabric from the one surface to the other surface and fixes the button main body to the other surface of the fabric; and a cap for covering an outer surface of the fixing member main body at the one surface of the fabric, a material of the cap being a polygonal plate, and the cap including: a main surface covering portion formed substantially at the center of the polygonal plate; and a plurality of holding piece portions formed by bending corners of the polygonal plate from an outer peripheral end of the main surface covering portion to a rear surface side of the main surface covering portion.

7. A button comprising:

a button main body; and a plurality of holding piece portions, a material of the button being a polygonal plate, the button main body being formed substantially at the center of the polygonal plate, and the plurality of holding piece portions being formed by bending corners of the polygonal plate from an outer peripheral end of the button main body to a rear surface side of the button main body, wherein the button is fixed to a fabric by penetrating the fabric with the corners of the polygonal plate.

* * * * *

UNITED STATES PATENT AND TRADEMARK OFFICE

CERTIFICATE OF CORRECTION

PATENT NO. : 7,644,476 B2
APPLICATION NO. : 11/636190
DATED : January 12, 2010
INVENTOR(S) : Yoshio Takamura It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 460 days.

Signed and Sealed this

Twenty-first Day of December, 2010

David J. Kappos

David J. Kappos
*Director of the United States Patent and Trademark Office*